US007248025B2

(12) United States Patent
Adachi

(10) Patent No.: US 7,248,025 B2
(45) Date of Patent: Jul. 24, 2007

(54) VOLTAGE REGULATOR WITH IMPROVED POWER SUPPLY REJECTION RATIO CHARACTERISTICS AND NARROW RESPONSE BAND

(75) Inventor: Masahiro Adachi, Kanagawa (JP)

(73) Assignee: NEC Electronics Corporation, Kanagawa (JP)

( * ) Notice: Subject to any disclaimer, the term of this patent is extended or adjusted under 35 U.S.C. 154(b) by 265 days.

(21) Appl. No.: 11/117,528

(22) Filed: Apr. 29, 2005

(65) Prior Publication Data

US 2005/0248325 A1 Nov. 10, 2005

(30) Foreign Application Priority Data

Apr. 30, 2004 (JP) ..... 2004-135112

(51) Int. Cl.
*G05F 1/565* (2006.01)

(52) U.S. Cl. ..... 323/273; 323/280

(58) Field of Classification Search ..... 323/273, 323/280

See application file for complete search history.

(56) References Cited

U.S. PATENT DOCUMENTS 6,246,221 B1 6/2001 Xi
6,249,112 B1 * 6/2001 Khouri et al. ..... 323/282
6,518,737 B1 * 2/2003 Stanescu et al. ..... 323/280
6,677,735 B2 1/2004 Xi
6,696,822 B2 * 2/2004 Takabayashi ..... 323/224
6,710,583 B2 * 3/2004 Stanescu et al. ..... 323/280
6,828,763 B2 * 12/2004 Sudou et al. ..... 323/226
6,856,123 B2 * 2/2005 Takabayashi ..... 323/273
7,091,709 B2 * 8/2006 Suzuki ..... 323/274

FOREIGN PATENT DOCUMENTS

JP 10-260741 A 9/1998
JP 2001-159922 A 6/2001

* cited by examiner

*Primary Examiner*—Jeffrey Sterrett
(74) *Attorney, Agent, or Firm*—Sughrue Mion, PLLC

(57) ABSTRACT

In a voltage regulator, a reference voltage generating circuit generates a reference voltage. A drive transistor is connected between a first power supply terminal and an output terminal and has a control terminal. A voltage divider generates a feedback voltage which is an intermediate voltage between voltages at the output terminal and a first power supply terminal. A differential amplifier generates an error voltage in accordance with the feedback voltage of the voltage divider and the reference voltage, and transmits it to the control terminal of the drive transistor. An oscillation preventing capacitor is connected between the control of the drive transistor and the output terminal. A capacitor is connected between the first power supply terminal and the first input of the differential amplifier.

16 Claims, 10 Drawing Sheets

REFERENCE VOLTAGE GEN. CIRCUIT
1
2
$V_{REF}$
GND
$V_{FB}$
22-1
22-2
22-3
21-1
21-2
21-3
5
6
$V_{ER}$
$V_{OUT}$
3
4
23
221
222
$V_1$
234
CMP
235
233
$V_{R2}$
$V_{R1}$
OUT
11
12
L
GND
T1
$V_{CC}$
20
T2

REFERENCE VOLTAGE GEN. CIRCUIT
1
2
$V_{REF}$
GND
$V_{FB}$
32-1
32-2
32-3
31-1
31-2
31-3
D0
D1
D2
A/D
333
331
332
33
5
6
$V_{ER}$
$V_{OUT}$
3
4
T1
30
$V_{CC}$
OUT
11
12
L
GND
T2

REFERENCE VOLTAGE GEN. CIRCUIT
1
2
GND
$V_{REF}$
41
$V_1$
421
422
42
$V_{ER}$
6
5
$V_{CC}$
T1
40
$V_{OUT}$
OUT
3
4
T2
GND
11
GND
12
GND

VOLTAGE REGULATOR WITH IMPROVED POWER SUPPLY REJECTION RATIO CHARACTERISTICS AND NARROW RESPONSE BAND

BACKGROUND OF THE INVENTION

1. Field of the Invention

The present invention relates to a voltage regulator having improved power supply rejection ratio (PSRR) characteristics while maintaining a narrow response band.

2. Description of the Related Art

Voltage regulators have been incorporated in mobile stations such as mobile telephone sets or electronic notebooks which need to be small both in size and power consumption.

In a first prior art voltage regulator (see: FIG. 2 of JP-10-260741-A), a reference voltage generating circuit generates a reference voltage. A drive transistor is connected between a power supply terminal and an output terminal and has a control terminal. A voltage divider generates a feedback voltage which is an intermediate voltage between voltages at the output terminal and the ground terminal. A differential amplifier generates an error voltage in accordance with the feedback voltage of the voltage divider and the reference voltage, and transmit it to the control terminal of the drive transistor. An oscillation preventing capacitor is connected between the control terminal of the drive transistor and the output terminal. This will be explained later in detail.

In the above-described first prior art voltage regulator, since the circuit current of the differential amplifier is relatively small and the capacitance of the oscillation preventing capacitor is relatively large, the response band is so narrow that the operation is stable. However, if a high frequency noise higher than a predetermined value is applied to the power supply voltage, the PSRR characteristics deteriorate rapidly, so that such a high frequency noise cannot be compensated for by the negative feedback control. As a result, such a high frequency noise would appear at the output terminal.

In the above-described first prior art voltage regulator, in order to improve the PSRR characteristics at a higher frequency, one approach to is increase the circuit current of the differential amplifier, and another approach is to decrease the capacitance of the oscillation preventing capacitor. In this case, however, the response band is also broadened, so that the operation would be unstable. Also, the former approach would increase the power consumption.

In a second prior art voltage regulator (see: JP-2001-159922-A), differential amplifiers (operational amplifiers) are added to the elements of the above-described first prior art voltage regulator. This also will be explained later in detail. As a result, the amplification of a differential amplifier section formed by the differential amplifiers is increased to improve the PSRR characteristics.

Even in the above-described second prior art voltage regulator, however, the response band would be broadened. Also, since the number of differential amplifiers (operational amplifiers) is increased, the power consumption would be increased and the circuit size would be increased.

SUMMARY OF THE INVENTION

It is an object of the present invention to provide a voltage regulator having improved PSRR characteristics while maintaining the narrow response band, and capable of being incorporated into a mobile station which needs to be small both in size and power consumption.

According to the present invention, in a voltage regulator, a reference voltage generating circuit generates a reference voltage. A drive transistor is connected between a first power supply terminal and an output terminal and has a control terminal. A voltage divider generates a feedback voltage which is an intermediate voltage between voltages at the output terminal and a first power supply terminal. A differential amplifier generates an error voltage in accordance with the feedback voltage of the voltage divider and the reference voltage, and transmits it to the control terminal of the drive transistor. An oscillation preventing capacitor is connected between the control terminal of the drive transistor and the output terminal. A capacitor is connected between the first power supply terminal and the first input of the differential amplifier.

The capacitor passes a high frequency noise higher than a predetermined value which is determined by a response band formed by a negative feedback control of the drive transistor and the differential amplifier. Therefore, the capacitor passes such a high frequency noise to the negative feedback control to improve the PSRR characteristics. Note that, since the capacitor in not within the negative feedback control, the capacitor does not broaden the response band of the negative feedback control.

BRIEF DESCRIPTION OF THE DRAWINGS

The present invention will be more clearly understood from the description set forth below, as compared with the prior art, with reference to the accompanying drawings, wherein.

DESCRIPTION OF THE PREFERRED EMBODIMENTS

Before the description of the preferred embodiments, a prior art voltage regulator will be explained with reference to FIGS. 1, 2A, 2B, 3A, 3B and 4.

Figure 1:
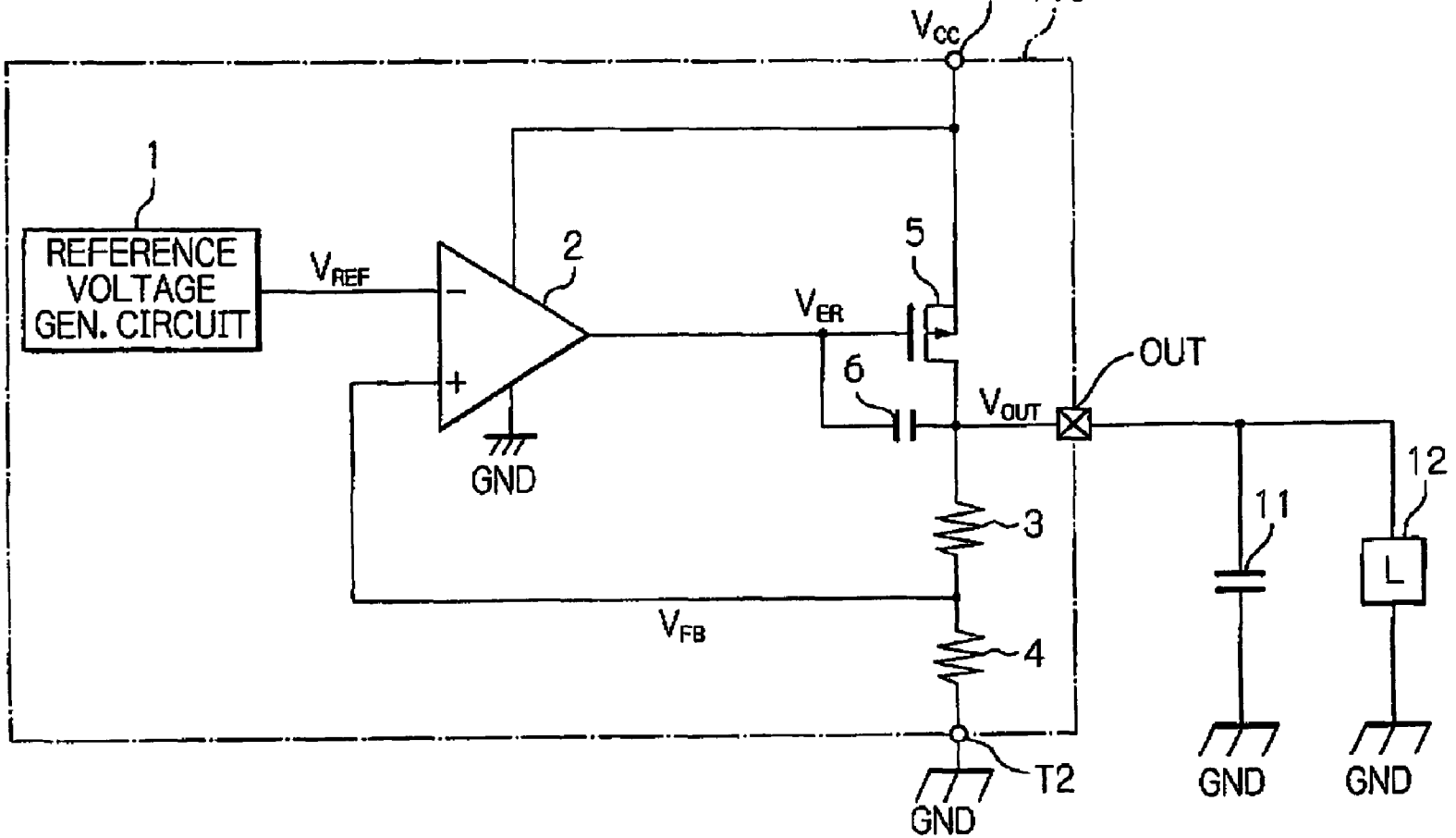
Fig. 1 PRIOR ART
FIG. 1 is a circuit diagram illustrating a first prior art voltage regulator.

In FIG. 1, which illustrates a first prior art voltage regulator 100 (see: FIG. 2 of JP-10-260741-A), a reference voltage generating circuit 1 generates a reference voltage $V_{REF}$ and applies it to a negative input of a differential amplifier (operational amplifier) 2 whose positive input receives a feedback voltage $V_{FB}$ from a voltage divider formed by resistors 3 and 4.

The differential amplifier 2 whose circuit current is relatively small generates an error voltage $V_{ER}$ in accordance with a difference between the feedback voltage $V_{FB}$ and the reference voltage $V_{REF}$ and applies it to a gate of a drive P-channel MOS transistor 5. As a result, the drive P-channel MOS transistor 5 generates an output voltage $V_{OUT}$ at its drain, i.e., at an output terminal OUT.

An oscillation preventing capacitor 6 whose capacitance is relatively large is connected between the gate and drain of the drive P-channel MOS transistor 5.

An external capacitor 11 and an external load 12 are connected to the output terminal OUT.

A power supply voltage $V_{CC}$ and a ground voltage GND are applied to terminals T1 and T2, respectively, where a series of the drive P-channel MOS transistor 5 and the resistors 3 and 4 are connected.

In FIG. 1, a negative feedback control is carried out, that is, the output voltage $V_{OUT}$ is fed back as the feedback voltage $V_{FB}$ via the differential amplifier 2 to the gate of the drive P-channel MOS transistor 5, so that the fluctuation of the output voltage $V_{OUT}$ can be suppressed.

Figure 2A:
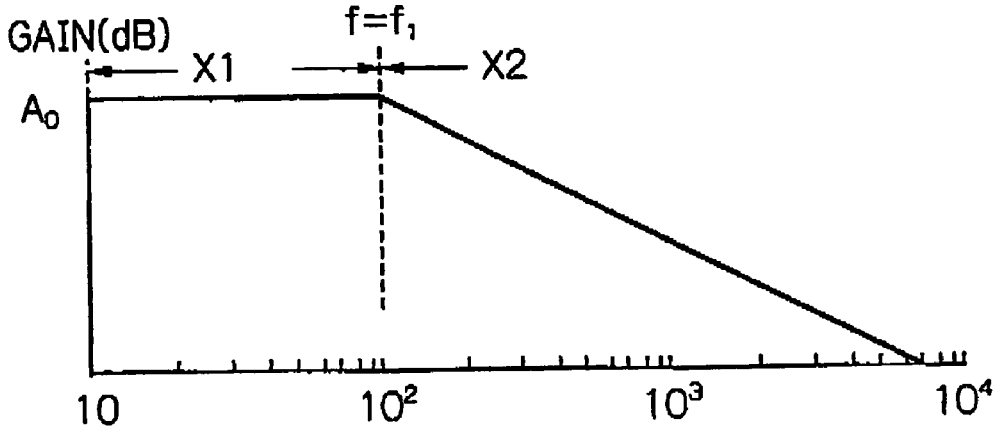
Fig. 2A PRIOR ART
FIG. 2A is a graph showing the gain characteristics of the voltage regulator of FIG. 1 where the circuit current of the differential amplifier is relatively small and the capacitance of the oscillation preventing capacitor is relatively large.
Figure 2B:
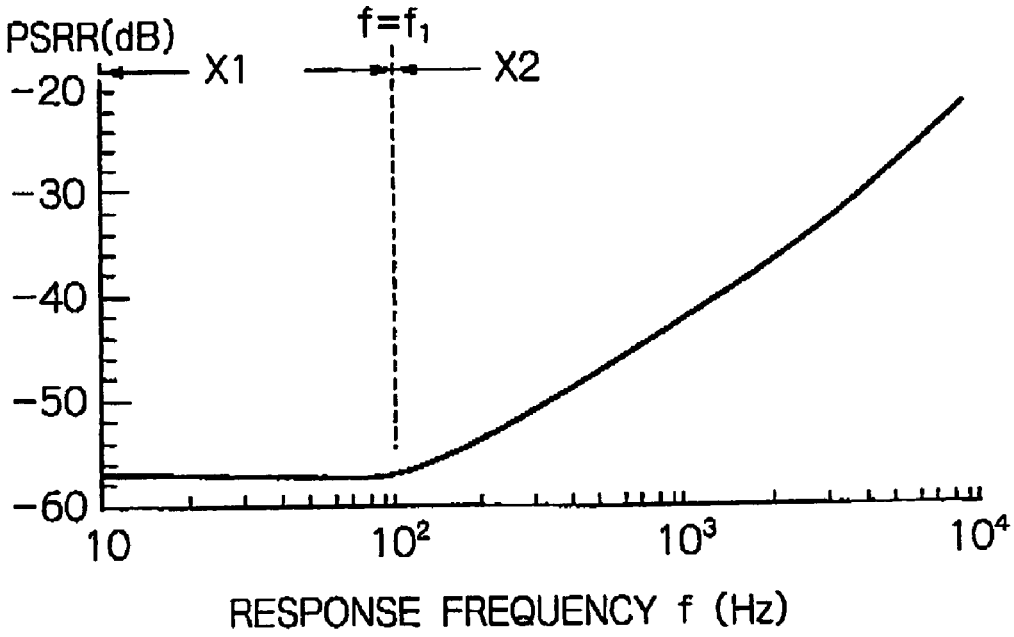
Fig. 2B PRIOR ART
FIG. 2B is a graph showing the PSRR characteristics of the voltage regulator of FIG. 1 where the circuit current of the differential amplifier is relatively small and the capacitance of the oscillation preventing capacitor is relatively large.

Also, since the oscillation preventing capacitor 6 is provided, even if a low frequency noise lower than a predetermined value $f_1$ is applied to the power supply voltage $V_{CC}$, the gain is maintained at an open-loop gain $A_0$ as indicated by X1 in FIG. 2A which shows the gain characteristics of the voltage regulator 100 of FIG. 1, and the power supply rejection ratio (PSRR) characteristics do not deteriorate as indicated by X1 in FIG. 2B which shows the PSRR characteristics of the voltage regulator 100 of FIG. 1.

In the voltage regulator 100 of FIG. 1, since the circuit current of the differential amplifier 2 is relatively small and the capacitance of the oscillation preventing capacitor 6 is relatively large, the response band as indicated by X1 in FIG. 2A is so narrow that the operation is stable. However, if a high frequency noise higher than the frequency $f_1$ is applied to the power supply voltage $V_{CC}$, the gain is decreased as indicated by X2 in FIG. 2A, and simultaneously, the PSRR characteristics deteriorate rapidly as indicated by X2 in FIG. 2B, so that such a high frequency noise cannot be compensated for by the negative feedback control. As a result, such a high frequency noise would appear at the output terminal OUT.

Figure 3A:
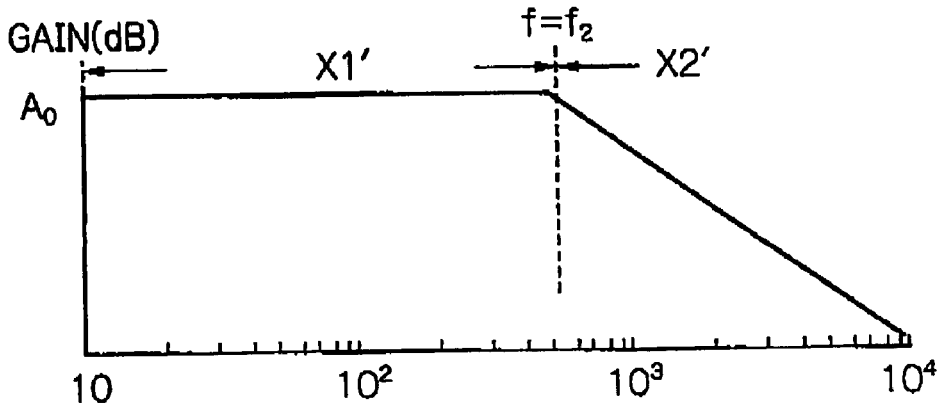
Fig. 3A PRIOR ART
FIG. 3A is a graph showing the gain characteristics of the voltage regulator of FIG. 1 where the circuit current of the differential amplifier is relatively large or the capacitance of the oscillation preventing capacitor is relatively small.
Figure 3B:
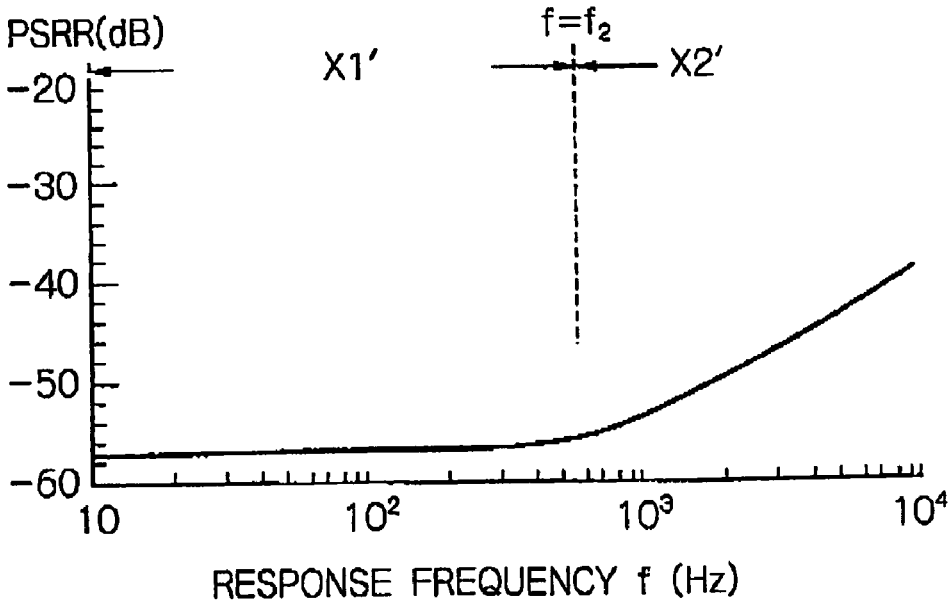
Fig. 3B PRIOR ART
FIG. 3B is a graph showing the PSRR characteristics of the voltage regulator of FIG. 1 where the circuit current of the differential amplifier is relatively large or the capacitance of the oscillation preventing capacitor is relatively small.

In the voltage regulator 100 of FIG. 1, in order to improve the PSRR characteristics at a higher frequency indicated by X1' in FIG. 3B, one approach is to increase the circuit current of the differential amplifier 2, and another approach is to decrease the capacitance of the oscillation preventing capacitor 6. In this case, however, the response band is also broadened as indicated by X1' in FIG. 3A, so that the operation is would be unstable. Also, the former approach would increase the power consumption.

Figure 4:
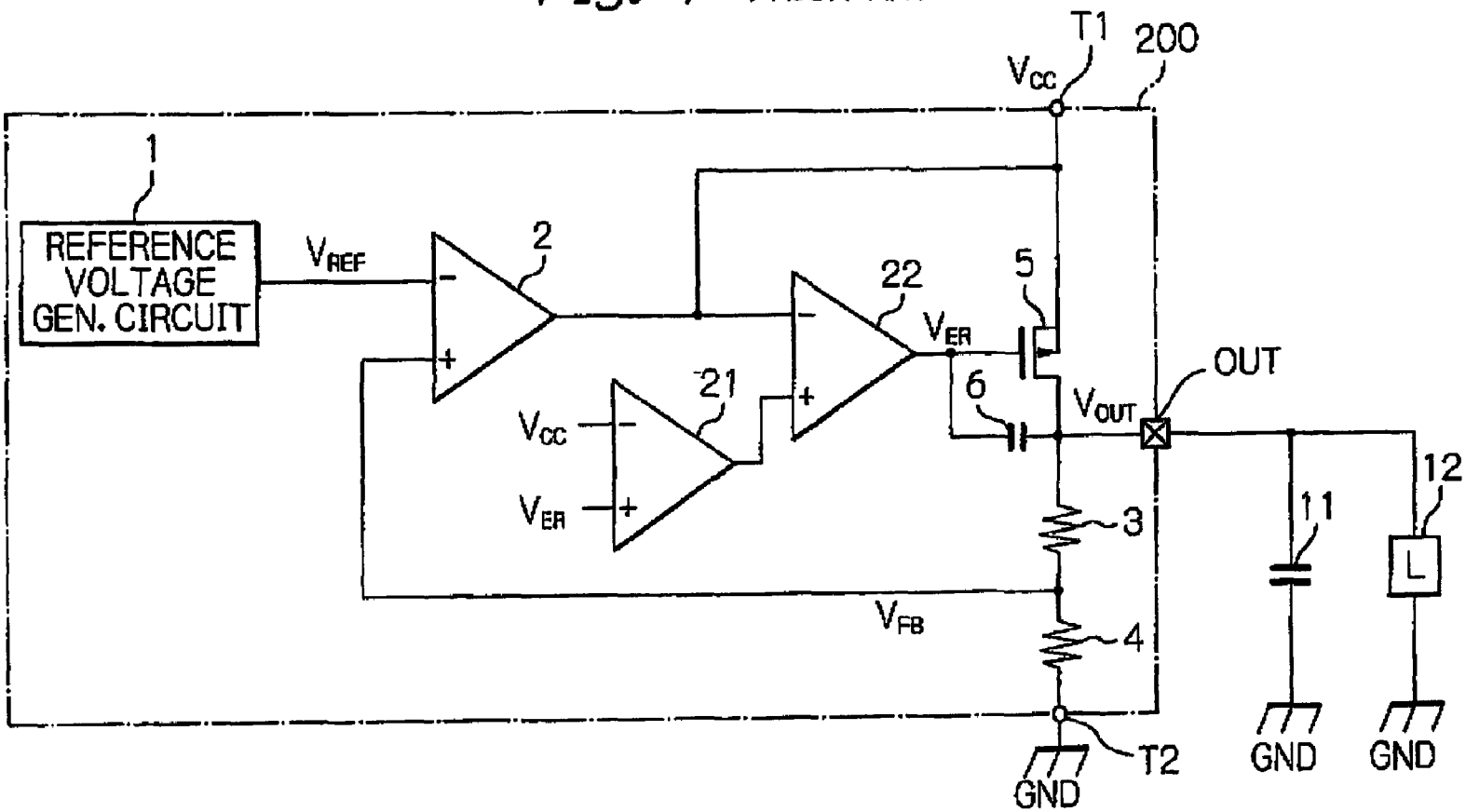
Fig. 4 PRIOR ART
FIG. 4 is a circuit diagram illustrating a second prior art voltage regulator.

In FIG. 4, which illustrates a second prior art voltage regulator (see: JP-2001-159922-A), a voltage regulator 200 includes differential amplifiers (operational amplifiers) 21 and 22 in addition to the voltage regulator 100 of FIG. 1. As a result, the amplification of a differential amplifier section is increased to improve the PSRR characteristics as shown in FIG. 3B. Even in this case, the response band would be broadened as shown in FIG. 3A. Also, since the number of differential amplifiers (operational amplifiers) is increased, the power consumption would be increased and the circuit size would be increased.

Figure 5:
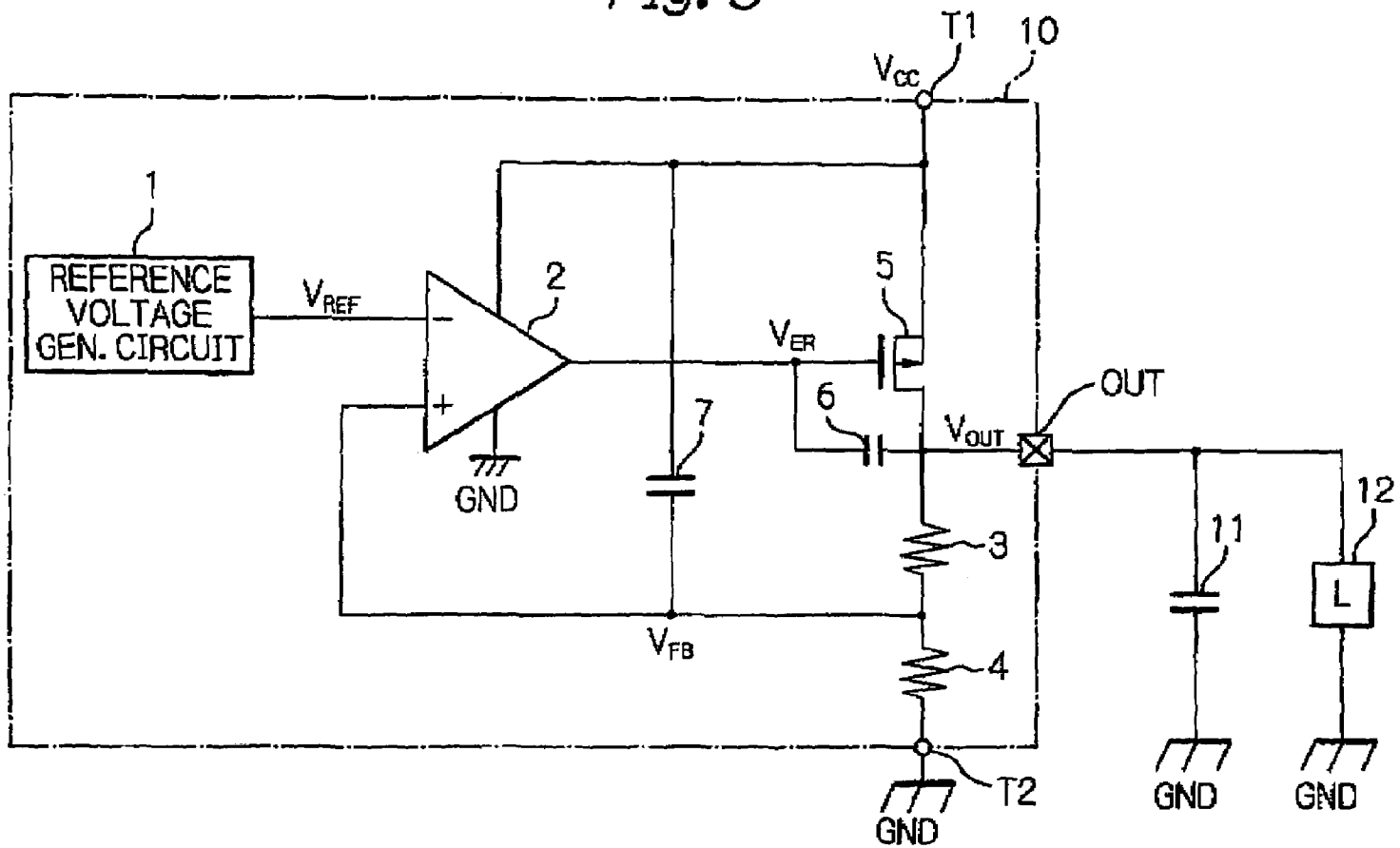
FIG. 5 is a circuit diagram illustrating a first embodiment of the voltage regulator according to the present invention.

In FIG. 5, which illustrates a first embodiment of the voltage regulator according to the present invention, a voltage regulator 10 includes a capacitor 7 in addition to the voltage regulator 100 of FIG. 1.

Figure 6A:
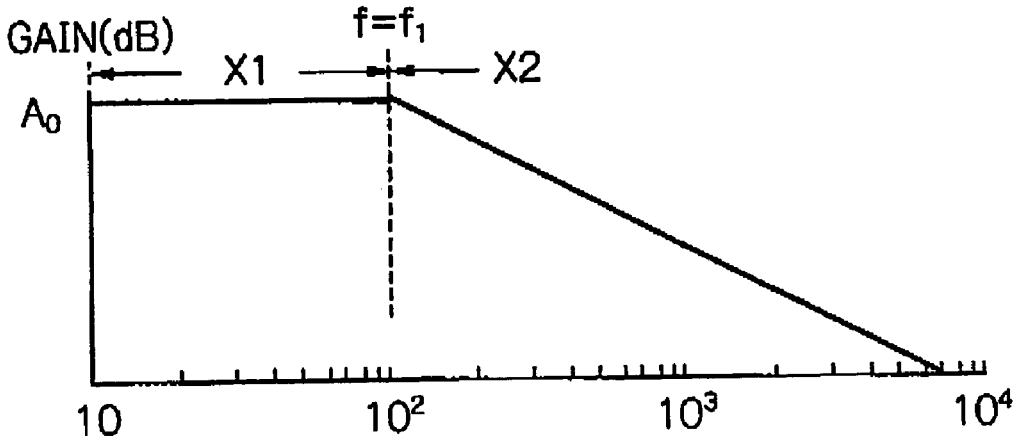
FIG. 6A is a graph showing the gain characteristics of the voltage regulator of FIG. 5 where the circuit current of the differential amplifier is relatively small and the capacitance of the oscillation preventing capacitor is relatively large.

The gain characteristics of the voltage regulator 10 of FIG. 5 are as shown in FIG. 6A where a response band is limited by the oscillation preventing capacitor 6. Note that since the capacitance of the oscillation preventing capacitor 6 is relatively large, an upper frequency $f_1$ defined by the response band is 80 Hz, for example. Therefore, if a low frequency noise lower than the frequency $f_1$ is applied to the power supply voltage $V_{CC}$, the negative feedback control using the feedback voltage $V_{FB}$ is carried out to compensate for the low frequency noise, so that the output voltage $V_{OUT}$ is not affected by the low frequency noise.

Figure 6B:
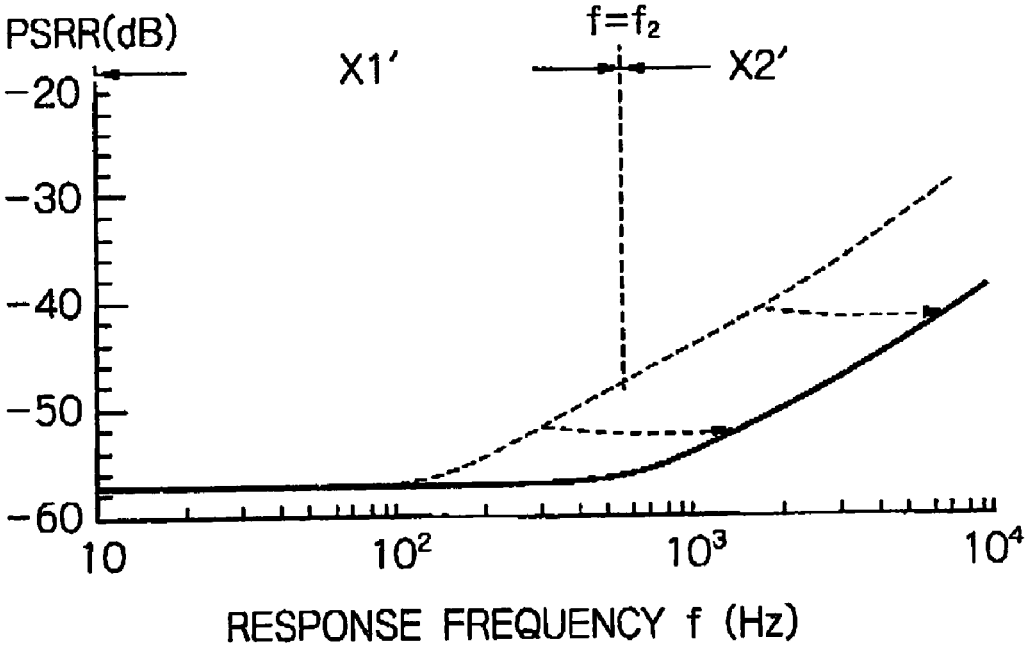
FIG. 6B is a graph showing the PSRR characteristics of the voltage regulator of FIG. 5 where the circuit current of the differential amplifier is relatively small and the capacitance of the oscillation preventing capacitor is relatively large.

On the other hand, the capacitance of the capacitor 7 is determined to pass a high frequency noise higher than the frequency $f_1$ applied to the power supply voltage $V_{CC}$ therethrough to the input of the differential amplifier 2 which receives the feedback voltage $V_{FB}$. Therefore, the capacitor 7 does not affect the gain characteristics as shown in FIG. 6A, but the capacitor 7 affects, i.e., improves the PSRR characteristics as shown in FIG. 6B where the PSRR is increased at a frequency $f_2$ such as 500 Hz higher than the frequency $f_1$.

As a result, if a high frequency noise having a frequency higher than the frequency $f_1$ is applied to the power supply voltage $V_{CC}$, such a noise is superposed onto the feedback voltage $V_{FB}$, and fed back to the differential amplifier 2, so that the high frequency noise is compensated for.

In the voltage regulator 10 of FIG. 5, since the circuit current of the differential amplifier 2 is relatively small, the power consumption is small.

Thus, since only the capacitor 7 is added to the voltage regulator 100 of FIG. 1, the voltage regulator 10 of FIG. 5 is not so large in size.

In the voltage regulator 10 of FIG. 5, when the resistance of the external load 12 is changed, the gain of the drive P-channel MOS transistor 5 is also changed, so that the response band defined by the frequency $f_1$ of FIG. 6A is changed. That is, the smaller the resistance of the external load 12, the higher the frequency $f_1$ of FIG. 6A. Thus, it is preferable that the capacitance of the capacitor 7 is changed in accordance with the resistance of the external load 12, which is realized by the following second, third and fourth embodiments.

Figure 7:
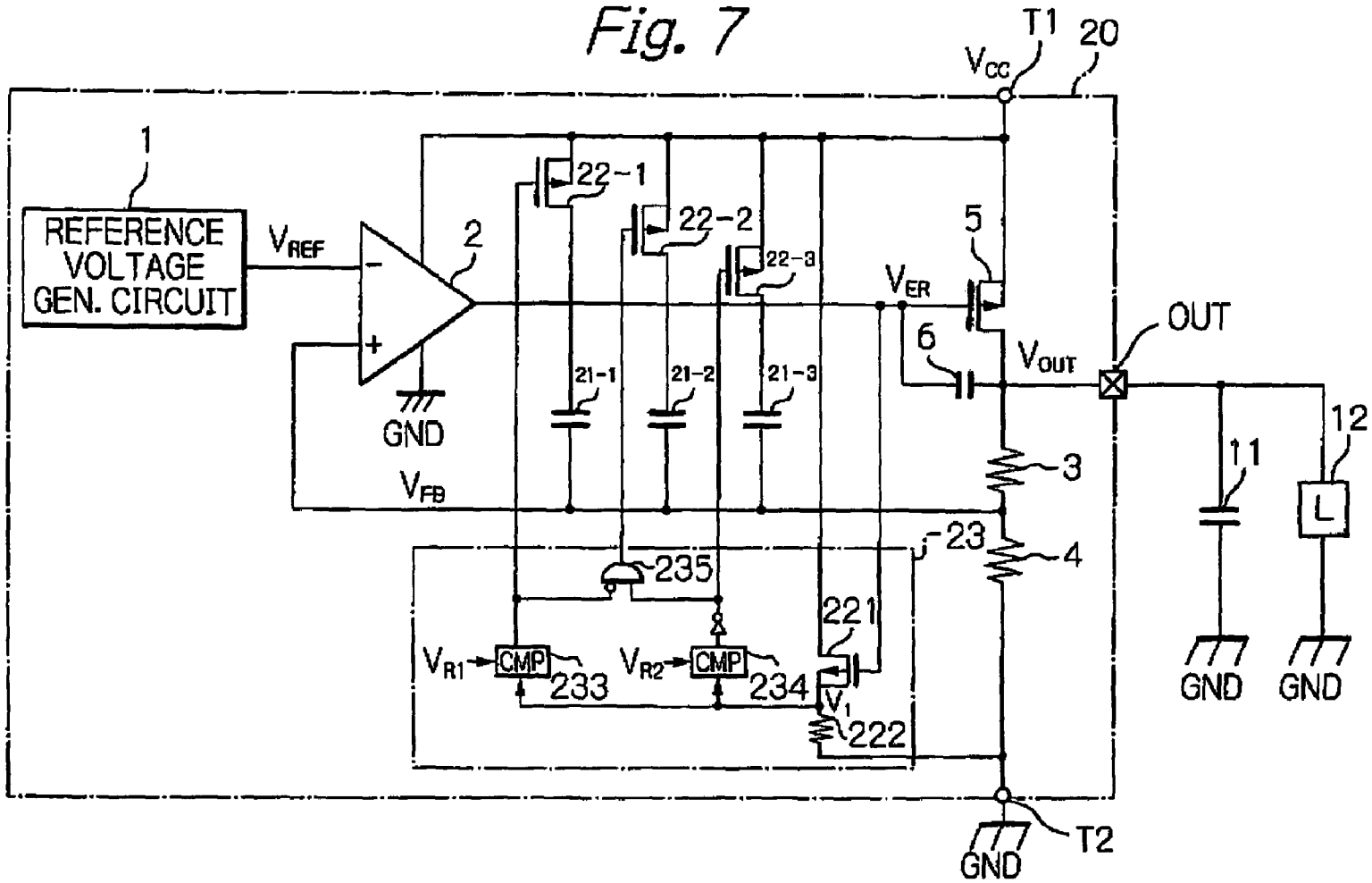
FIG. 7 is a circuit diagram illustrating a second embodiment of the voltage regulator according to the present invention.

In FIG. 7, which illustrates a second embodiment of the voltage regulator according to the present invention, a voltage regulator 20 includes capacitors 21-1, 21-2 and 21-3 associated with switches formed by P-channel MOS transistors 22-1, 22-2 and 22-3, respectively, and a control circuit 23, instead of the capacitor 7 of the voltage regulator 10 of FIG. 5. In this case, the capacitances C1, C2 and C3 of the capacitors 21-1, 21-2 and 21-3 are different from each other, i.e.,

C1<C2<C3.

The control circuit 23 is constructed by a voltage detector formed by a P-channel MOS transistor 231 for detecting a source-to-gate voltage of the drive P-channel MOS transistor 5 depending upon the resistance value of the external load 12, a resistor 232 connected to the drain of the P-channel MOS transistor 231, comparators 233 and 234 for comparing a voltage $V_1$ between the P-channel MOS transistor 231 and the resistor 232 with reference voltages $V_{R1}$ and $V_{R2}$ ($V_{R1}<V_{R2}$), and a gate circuit 235. As a result, when $V_1<V_{R1}$, the switch P-channel MOS transistor 22-1 is turned ON to select the capacitor 21-1. Also, when $V_{R1}\leqq V_1<V_{R2}$, the switch (P-channel MOS transistor) 22-2 is turned on to select the capacitor 21-2. Further, when $V_1\geqq V_{R2}$, the switch (P-channel MOS transistor) 22-3 is turned ON to select the capacitor 21-3.

Figure 8:
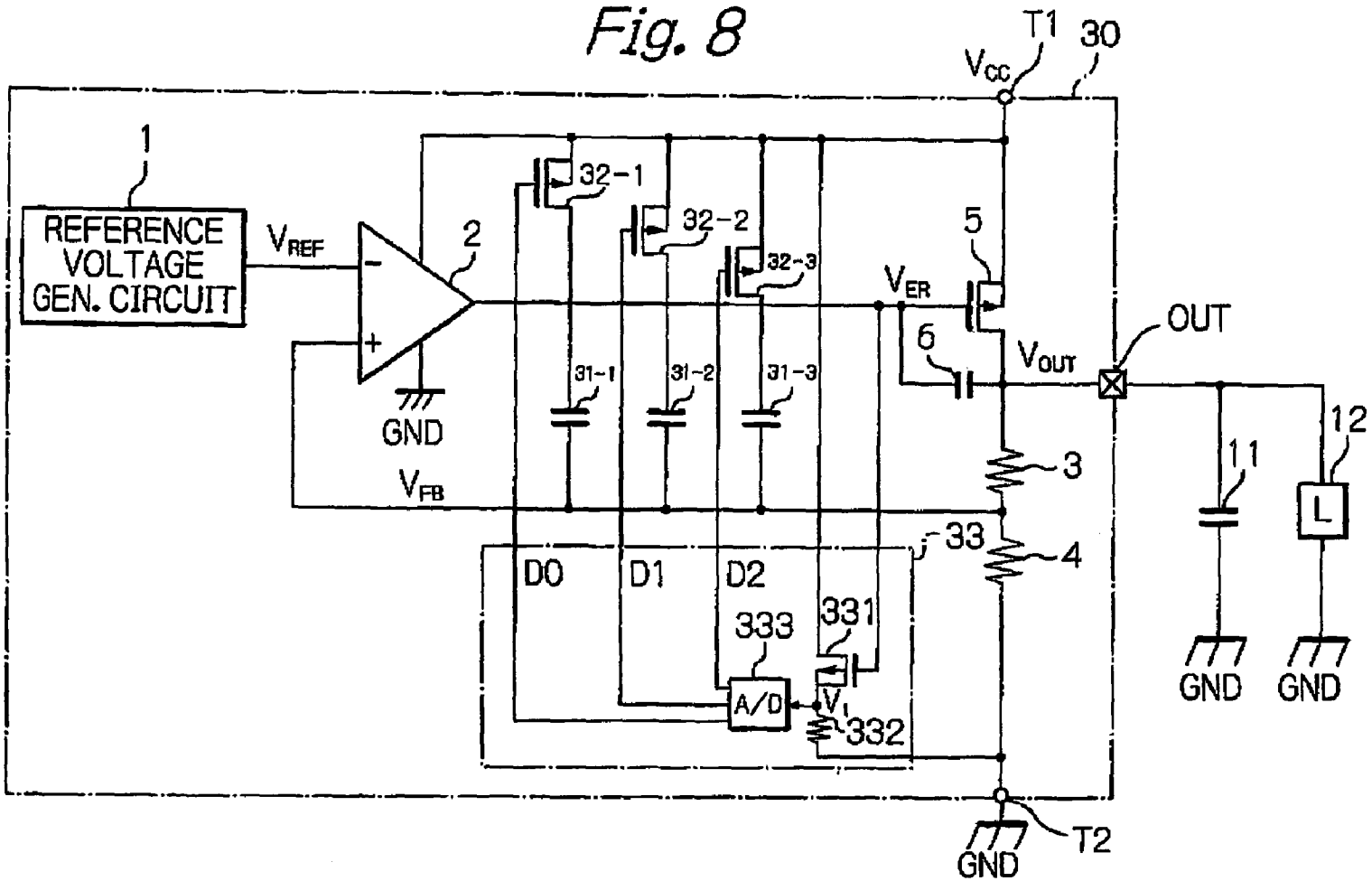
FIG. 8 is a circuit diagram illustrating a third embodiment of the voltage regulator according to the present invention.

In FIG. 8, which illustrates a third embodiment of the voltage regulator according to the present invention, a voltage regulator 30 includes capacitors 31-1, 31-2 and 31-3, whose capacitances are $C_0$:$2C_0$:$4C_0$, associated with switches (P-channel MOS transistors) 32-1, 32-2 and 32-3, respectively, and a control circuit 33, instead of the capacitor 7 of the voltage regulator 10 of FIG. 5.

The control circuit 33 is constructed by a voltage detector formed by a P-channel MOS transistor 331 for detecting a source-to-gate voltage of the drive P-channel MOS transistor 5 depending upon the resistance of the load 12, a resistor 332 connected to the drain of the P-channel MOS transistor 331, and an analog/digital (A/D) converter 333 for performing an A/D conversion upon a voltage $V_1$ between the P-channel MOS transistor 331 and the resistor 332 to generate three-bit data (D0, D1, D2). As a result, the switches (P-channel MOS transistors) 32-1, 32-2 and 32-3 are turned ON in accordance with the output signal of the A/D converter 333. For example, if (D0, D1, D2)=(0, 1, 0), only the capacitor 31-2 is selected, so that the capacitance of the entirety of the capacitors 31-1, 31-2 and 31-3 is $2C_0$. Also, if (D0, D1, D2)=(1, 1, 1), the capacitors 31-1, 31-2 and 31-3 are selected so that the capacitance of the entirety of the capacitors 31-1, 31-2 and 31-3 is $7C_0$ ($=C_0+2C_0+4C_0$). Note that data (0, 0, 0) is prohibited. Also, each bit "1" of the A/D converter 333 shows a low level, and each bit "0" of the A/D converter 33 shows a high level.

Figure 9:
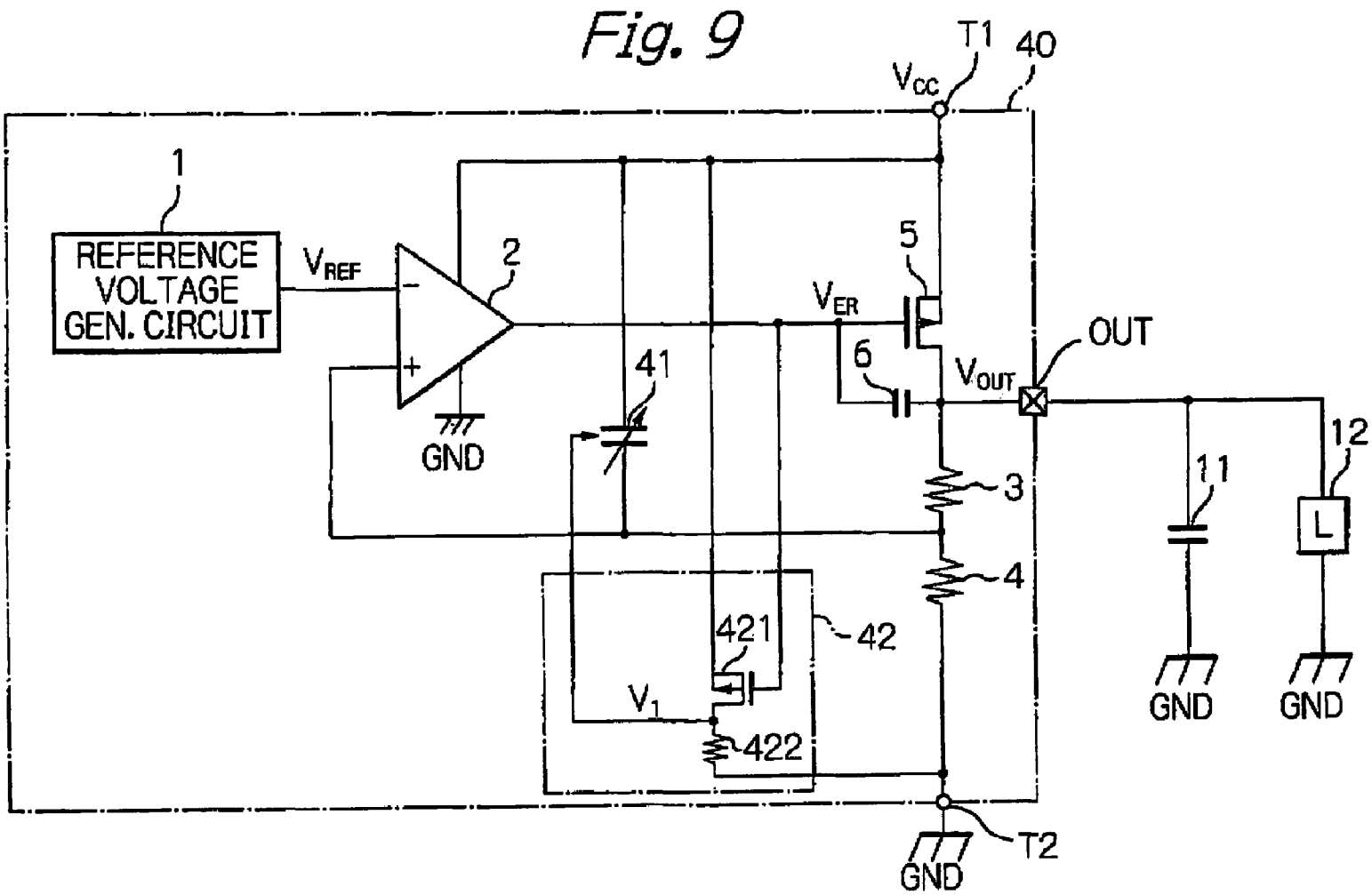
FIG. 9 is a circuit diagram illustrating a fourth embodiment of the voltage regulator according to the present invention.

In FIG. 9, which illustrates a fourth embodiment of the voltage regulator according to the present invention, a voltage regulator 40 includes a variable capacitor 41 and a control circuit 42, instead of the capacitor 7 of the voltage regulator 10 of FIG. 5.

The control circuit 42 is constructed by a voltage detector formed by a P-channel MOS transistor 421 for detecting a source-to-gate voltage of the drive P-channel MOS transistor 5 depending upon the resistance of the load 12, a resistor 422 connected to the drain of the P-channel MOS transistor 421. As a result, the capacitance of the variable capacitor 41 is controlled in accordance with a voltage $V_1$ between the drain of P-channel MOS transistor and the resistor 422.

In FIGS. 7 and 8, the number of capacitors associated with switches can be four or more. Also, in FIGS. 7, 8 and 9, the resistance of the load 12 can be monitored by the power supply voltage $V_{CC}$ and the output voltage $V_{OUT}$ instead of the power supply voltage $V_{CC}$ and the error voltage $V_{ER}$.

Figure 10:
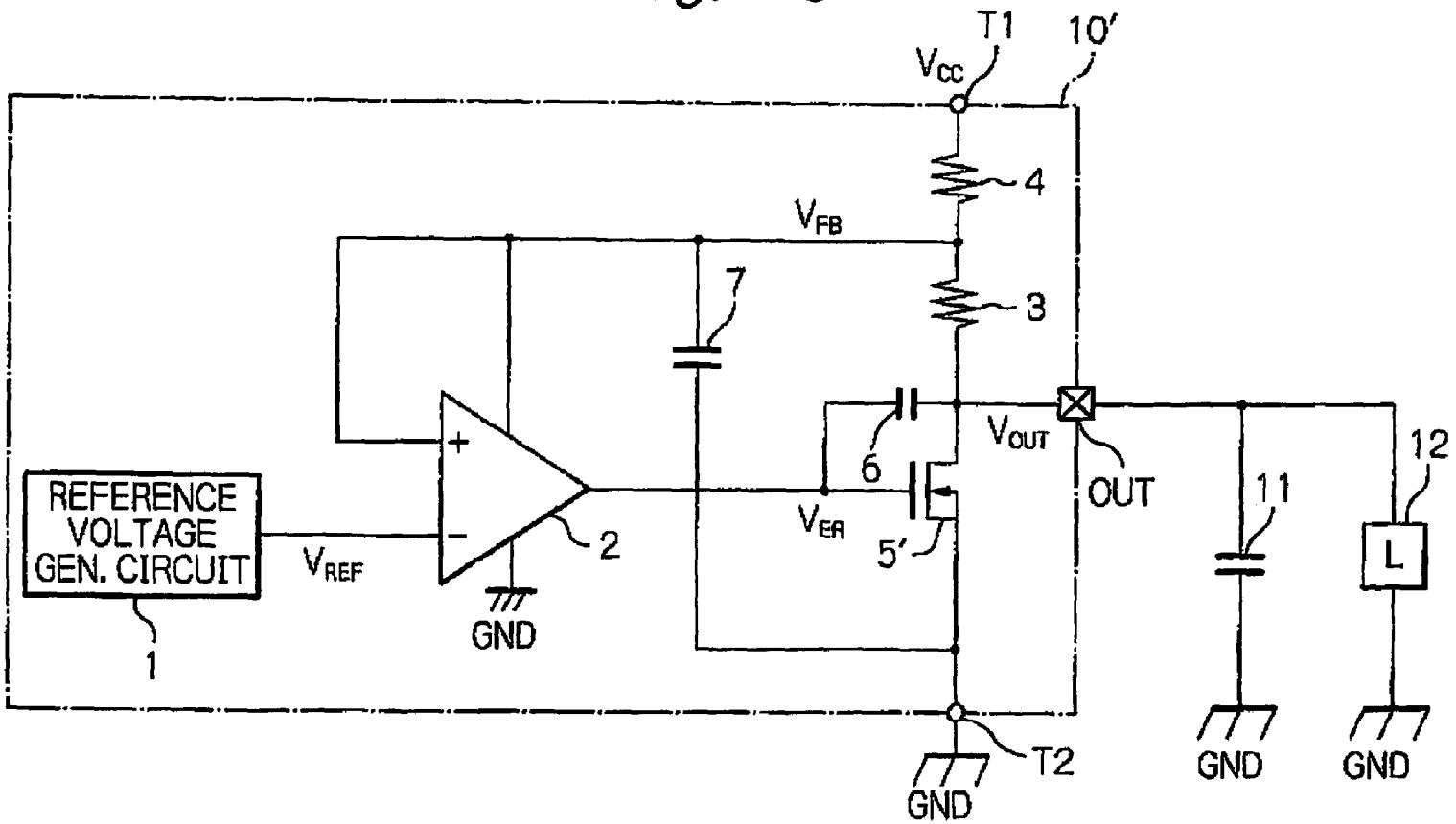
FIG. 10 is a circuit diagram illustrating a modification of the voltage regulator of FIG. 5.

Further, in FIGS. 5, 7, 8 and 9, the drive transistor 5 can be replaced by an N-channel MOS transistor, as illustrated in FIG. 10 which illustrates a modification of the voltage regulator 10 of FIG. 5.

As explained hereinabove, according to the present invention, the PSRR characteristics can be improved while maintaining the narrow response band.

The invention claimed is:

1. A voltage regulator comprising:

first and second power supply terminals;

an output terminal;

a reference voltage generating circuit adapted to generate a reference voltage;

a drive transistor connected between said first power supply terminal and said output terminal, said drive transistor having a control terminal;

a voltage divider connected between said output terminal and said second power supply terminal, said voltage divider adapted to generate a feedback voltage between voltages at said output terminal and said first power supply terminal;

a differential amplifier having a first input connected to said voltage divider, a second input connected to said reference voltage generating circuit and an output connected to the control terminal of said drive transistor, said differential amplifier adapted to generate an error voltage in accordance with said feedback voltage and said reference voltage and transmit said error voltage to the control terminal of said drive transistor;

an oscillation preventing capacitor connected between the control terminal of said drive transistor and said output terminal; and a capacitor connected between said first power supply terminal and the first input of said differential amplifier.

2. The voltage regulator as set forth in claim 1, wherein a capacitance of said capacitor is determined to pass a noise applied to said first power supply terminal, said noise having a higher frequency than a predetermined value defined by a negative feedback control of said drive transistor, said oscillation preventing capacitor, said voltage divider and said differential amplifier.

3. The voltage regulator as set forth in claim 1, wherein a capacitance of said capacitor is variable, said voltage regulator further comprising a control circuit connected to said capacitor and adapted to change the capacitance of said capacitor in accordance with a resistance of an external load connected to said output terminal.

4. The voltage regulator as set forth in claim 3, wherein said control circuit comprises:

a transistor, connected to said first power supply terminal and the control terminal of said drive transistor, said transistor being adapted to generate a current depending upon the difference in voltage between said first power supply terminal and the control terminal of said drive transistor; and a resistor connected between said transistor and said second power supply voltage and adapted to generate a voltage for controlling the capacitance of said capacitor in accordance with the current flowing through said transistor.

5. The voltage regulator as set forth in claim 1, wherein said drive transistor comprises a P-channel MOS transistor under the condition that a voltage at said first power supply terminal is higher than a voltage at said second power supply terminal.

6. The voltage regulator as set forth in claim 1, wherein said drive transistor comprises an N-channel MOS transistor under the condition that a voltage at said first power supply terminal is lower than a voltage at said second power supply terminal.

7. A voltage regulator comprising:

first and second power supply terminals;

an output terminal;

a reference voltage generating circuit adapted to generate a reference voltage;

a drive transistor connected between said first power supply terminal and said output terminal, said drive transistor having a control terminal;

a voltage divider connected between said output terminal and said second power supply terminal, said voltage divider adapted to generate a feedback voltage between voltages at said output terminal and said first power supply terminal;

a differential amplifier having a first input connected to said voltage divider, a second input connected to said reference voltage generating circuit and an output connected to the control terminal of said drive transistor, said differential amplifier adapted to generate an error voltage in accordance with said feedback voltage and said reference voltage and transmit said error voltage to the control terminal of said drive transistor;

an oscillation preventing capacitor connected between the control terminal of said drive transistor and said output terminal;

a plurality of capacitors associated with switches, connected between said first power supply terminal and the first input of said differential amplifier; and a control circuit connected to said plurality of capacitors and adapted to select said plurality of capacitors in accordance with a resistance of an external load connected to said output terminal.

8. The voltage regulator as set forth in claim 7, wherein said control circuit comprises:

a transistor, connected to said first power supply terminal and the control terminal of said drive transistor, said transistor being adapted to generate a current depending upon the difference in voltage between said first power supply terminal and the control terminal of said drive transistor;

a resistor connected between said transistor and said second power supply voltage and adapted to generate a voltage in accordance with the current flowing through said transistor; and a logic circuit connected to said resistor and adapted to select one of said plurality of capacitors.

9. The voltage regulator as set forth in claim 7, wherein said control circuit comprises:

a transistor, connected to said first power supply terminal and the control terminal of said drive transistor, said transistor being adapted to generate a current depending upon the difference in voltage between said first power supply terminal and the control terminal of said drive transistor;

a resistor connected between said transistor and said second power supply voltage and adapted to generate a voltage in accordance with the current flowing through said transistor; and an analog/digital converter connected to said resistor and adapted to select at least one of said plurality of capacitors.

10. The voltage regulator as set forth in claim 7, wherein said drive transistor comprises a P-channel MOS transistor under the condition that a voltage at said first power supply terminal is higher than a voltage at said second power supply terminal.

11. The voltage regulator as set forth in claim 7, wherein said drive transistor comprises an N-channel MOS transistor under the condition that a voltage at said first power supply terminal is lower than a voltage at said second power supply terminal.

12. A voltage regulator comprising:

first and second power supply terminals;

an output terminal;

a reference voltage generating circuit adapted to generate a reference voltage;

a drive transistor connected between said first power supply terminal and said output terminal and outputting an output voltage to said output terminal, said drive transistor having a control terminal;

a feedback circuit receiving said output voltage and generating a feedback voltage according to said output voltage;

a control circuit receiving said reference voltage at a reference terminal thereof and said feedback voltage at a feedback terminal thereof, said control circuit generating a control voltage by comparing said feedback voltage with said reference voltage and outputting said control voltage to said control terminal of said drive transistor; and a first capacitor connected between said first power supply and said feedback terminal.

13. The voltage regulator according to claim 12, wherein said feedback circuit has a first resistor, said first resistor causing an IR drop from said feedback voltage to a voltage of said second power supply terminal.

14. The voltage regulator according to claim 13, wherein said feedback circuit further has a second resistor, said second resistor causing an IR drop from a voltage of said first power supply terminal to said feedback voltage.

15. The voltage regulator according to claim 12, wherein said control circuit is a differential amplifier.

16. The voltage regulator according to claim 12, further comprising a second capacitor connected between said control terminal and said output terminal.

* * * * *